United States Patent [19]

Miller et al.

[11] Patent Number: 4,738,183

[45] Date of Patent: Apr. 19, 1988

[54] CLAM SHELL CONSTRUCTION AMMUNITION MAGAZINE

[75] Inventors: Mike Miller; Warren Stockton, both of Bakersfield, Calif.

[73] Assignee: Kern Instrument & Tooling, Inc., Bakersfield, Calif.

[21] Appl. No.: 845,331

[22] Filed: Mar. 28, 1986

[51] Int. Cl.[4] ..... F41C 25/10

[52] U.S. Cl. ..... 89/34; 89/33.17

[58] Field of Search ..... 89/34, 33.02, 33.17; 42/6, 49 R, 50, 49.01; 220/4 B, 4 E, 5 A; 29/463

[56] References Cited

U.S. PATENT DOCUMENTS

| | | | |
|---|---|---|---|
| 502,389 | 8/1893 | Whitten et al. . | |
| 869,484 | 10/1907 | Drake . | |
| 1,251,910 | 1/1918 | Murphy . | |
| 1,285,263 | 11/1918 | Lohne | 89/33.02 |
| 1,306,312 | 6/1919 | Peoples | 89/34 |
| 2,366,689 | 1/1945 | Trotter | 89/34 |
| 2,828,568 | 4/1958 | Sakewitz . | |
| 3,088,378 | 5/1963 | Boudreau . | |
| 3,091,487 | 5/1963 | Gallagher et al. . | |
| 3,498,178 | 3/1970 | Meyer et al. | 89/34 |
| 3,727,749 | 4/1973 | Martin | 220/4 E |
| 3,857,509 | 12/1974 | Baldwin et al. | 220/4 B |
| 4,034,644 | 7/1977 | Hupp et al. | 42/49.01 |
| 4,079,835 | 3/1978 | Kendig | 220/4 B |
| 4,218,420 | 8/1980 | Jacob et al. | 249/79 |
| 4,331,251 | 5/1982 | Berman et al. | 220/4 B |
| 4,389,918 | 6/1983 | Peck | 89/34 |
| 4,392,407 | 7/1983 | LaFever et al. | 89/34 |
| 4,466,754 | 8/1984 | Poitier | 403/11 |
| 4,542,923 | 9/1985 | LaCrosse et al. | 285/363 |
| 4,570,793 | 2/1986 | O'Neil et al. | 220/23.4 |
| 4,589,218 | 5/1986 | Teppa | 42/50 |

FOREIGN PATENT DOCUMENTS

| | | | |
|---|---|---|---|
| 0506045 | 5/1971 | Switzerland | 89/34 |
| 0590783 | 7/1947 | United Kingdom | 193/25 AC |

*Primary Examiner*—Stephen C. Bentley
*Assistant Examiner*—Stephen M. Johnson
*Attorney, Agent, or Firm*—Roylance, Abrams, Berdo & Goodman

[57] ABSTRACT

An improved magazine and method of its manufacture particularly designed for a specific gun/magazine system. The invention also pertains to the plastic molding arts in general. A magazine is provided having numerous features and advantages including means to permit assembly and disassembly using no tools or screw threaded fasteners or rivets or the like, viewing windows, and based upon symmetrical clam shell type halves having internal features necessary for proper functioning of the magazine.

14 Claims, 2 Drawing Sheets

CLAM SHELL CONSTRUCTION AMMUNITION MAGAZINE

REFERENCE TO RELATED APPLICATIONS

This application is related to our co-pending patent application U.S. Ser. No. 802,152 in the sense of enriching the disclosure of this application and providing additional background information. To that extent, the entire disclosure of said prior co-pending application is hereby incorporated by reference as if here set forth in full to the extent necessary for supporting the claims herein or for any other purpose.

INTRODUCTION

The present invention pertains to improved plastic molding techniques, and particularly to such techniques directed towards the manufacture of elongated hollow objects having complex internal surfaces. More specifically, the invention is directed towards the manufacture of an ammunition magazine of a particular variety the environment of which is described in detail in the above identified prior co-pending application. It is to be understood however that the invention is not limited to the manufacture of ammunition magazines, but could find applicability in many other related and unrelated fields both military and civilian. Elongated hollow objects having complex internal surfaces are found in many technological envorinments.

BACKGROUND OF THE INVENTION

As is developed in detail in our prior co-pending application, the gun/magazine system of that invention uses a magazine wherein the cartridges are fed therethrough in a spiral path around an elongated axis, and then exit in directions radial to the axis at one end of the magazine. Grooves are provided on the inside of the magazine to guide the cartridges around a central member and from one end to the other (exit) end. The invention of that system uses an unprecedented large capacity magazine, and the present invention is directed towards the manufacture of that magazine, and more particularly to the manufacture of the external shell thereof. The internal working parts do not form a part of the present invention, and complete disclosure thereof can be found in our prior co-pending application.

Good quality plastics adequate to meet the demands of the present invention are commercially available. It is highly desirable to make the invention ammunition magazine from plastic because of the advantages of lower cost, lighter weight, resistance to bending and denting, and other advantages well known to those skilled in these arts and as discussed in our prior co-pending application. At present, a certain nylon called Minlon (TM) by DuPont has been used to make the invention magazine. Conventional injection molding techniques will be employed.

While these materials are capable of very fine definition, and while molding techniques used with these materials are also capable of holding close tolerances, the problem in the prior art is that the invention magazine requires a great deal of detail, especially as to the screw threads, on the inside of surfaces thereof, and this is in addition to the need to hold close tolerances on those parts as well as various other parts of the magazine.

The invention is directed primarily towards improved techniques and features in such a magazine which will permit manufacture of such magazines in a highly efficient manner, at reduced costs, using conventional materials and techniques, while holding the necessary tolerances and qualities to provide a fully satisfactory plastic ammunition magazine housing.

SUMMARY AND ADVANTAGES OF THE INVENTION

Overall, the present invention provides an improved clam shell construction ammunition magazine suitable for use in the gun/magazine of the invention of our co-pending application, while providing numerous other advantageous features, as well as advantages of low cost, ease of manufacture, and the like.

The external housing of the invention magazine comprises a pair of halves, which are symmetrical to each other, and which are formed with half screw threads on their inside surfaces. The clam shell halves are held together by clips in such a way that the screw threads halves fit accurately together to form one continuous helical screw thread, for functional purposes, on the inside of the clam shell magazine housing. Mating pins and holes on the contacting edges of the two clam shell halves are provided to accurately fit the clam shell halves together into a complete housing over their entire length.

More specifically, among the advantages provided by the invention, is a construction wherein no screws, rivets, or other fasteners are required to hold the halves of the clam shell magazine together. A pair of elongated clips which fit into dove-tail grooves formed along the mating edges of the clam shell halves are provided for this purpose. The clips have built in locking fingers which hold the clam shell halves securely together, and which also permit simple removal using no tools other than readily available implements such as a pencil, a paper clip, a pin, or the like, to disassemble the clips and thus disassemble the magazine.

Another advantage of the invention resides in the provision of a pair of viewing windows and improved means to mount or locate said windows along the top surface of the magazine at the juncture of the two clam shell halves. The windows cooperate with suitable openings in the upper securing elongated clip, and other advantageous features are provided as to this aspect of the invention. The windows permit viewing of the ammunition inside the magazine to indicate to the user when the magazine is approximately half full and to indicate to the user when there are only a few rounds remaining in the magazine. This is, of course, a highly desirable advantage for the invention ammunition magazine in use.

The absence of screw threaded fasteners, rivets, and the like provides numerous advantages in and of itself including a strengthened construction because of the absence of holes and the like, simplicity of manufacture, use of fewer different materials, reduced weight, simplicity of disassembly and reassembly, and other such advantages well known to those skilled in these arts.

The symmetry of the two clam shell halves also provides advantages including ease of manufacture of the molds and other tools used to make the clam shell halves, simplicity of assembly, and other advantages well known to those skilled in these arts.

The above and other advantageous features and improvements of the invention will present themselves from a reading of the detailed description which follows, which disclosure includes the attached drawings.

DETAILED DESCRIPTION OF THE PREFERRED EMBODIMENT

Figure 1:
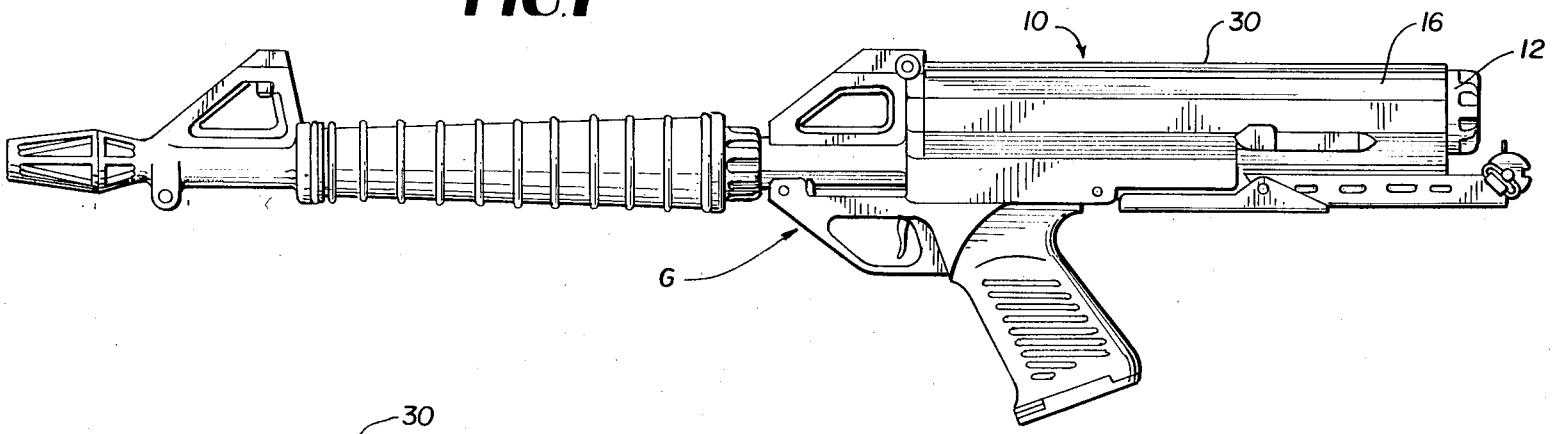
FIG. 1 is a side elevational view of the gun/magazine system of the invention of our prior co-pending application and which also shows the use of the improved magazine of the present invention.

FIG. 1 shows a gun G carrying a magazine 10. The gun G may be the same gun described and claimed in our prior co-pending application. The magazine 10 is, functionally, the same as the magazine of that prior application, the improvement of the present invention residing primarily in its construction and manner of manufacture.

Various parts of the gun including the manner in which it cooperates with the magazine of that disclosure as well as with the invention magazine, do not form a material part of the present invention. Reference may be had to that prior application for details.

Figure 2:
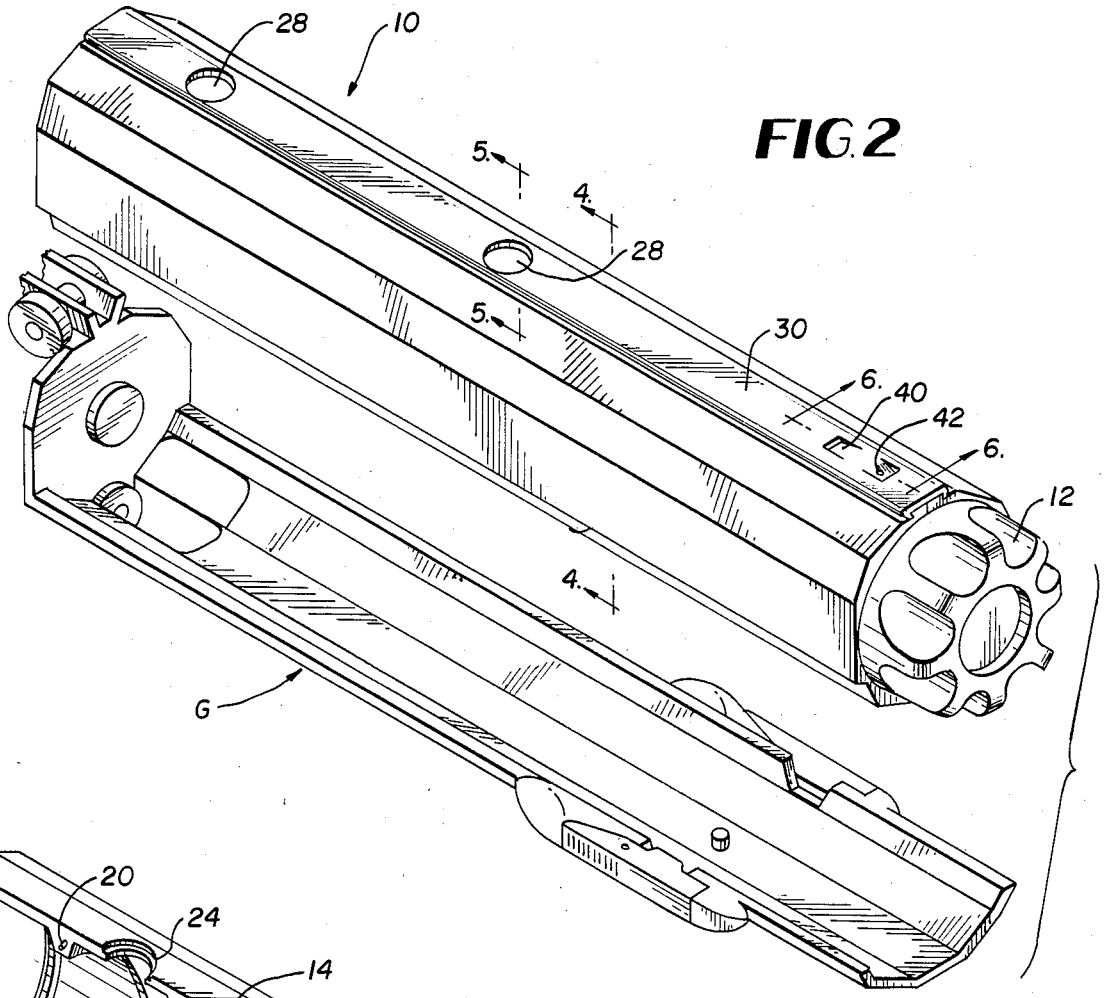
FIG. 2 is a partial exploded view showing the magazine removed from the gun of FIG. 1.

The magazine 10 includes numerous internal working parts, the winder 12 of which is shown in FIG. 2. Here again, these magazine working parts do not form a material part of the present invention, and reference may be had to our prior co-pending application for more details as to that aspect.

Figure 5:
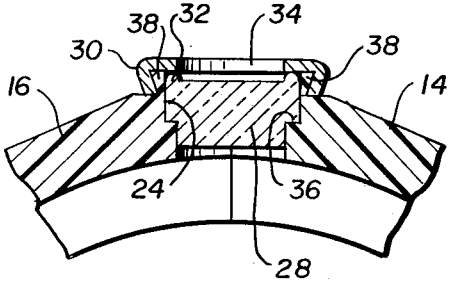
Figure 4:
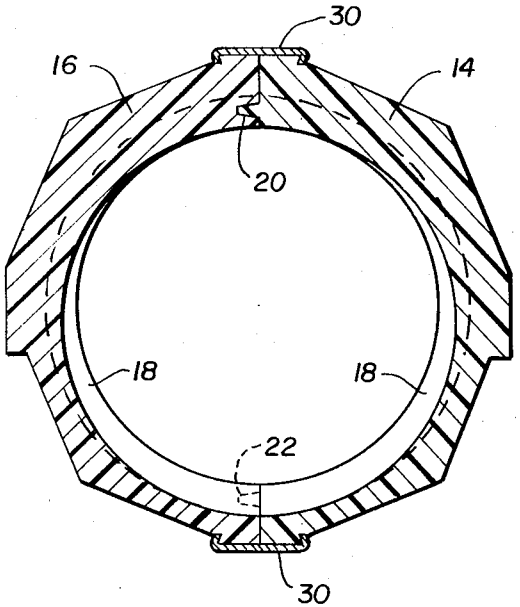
Figure 3:
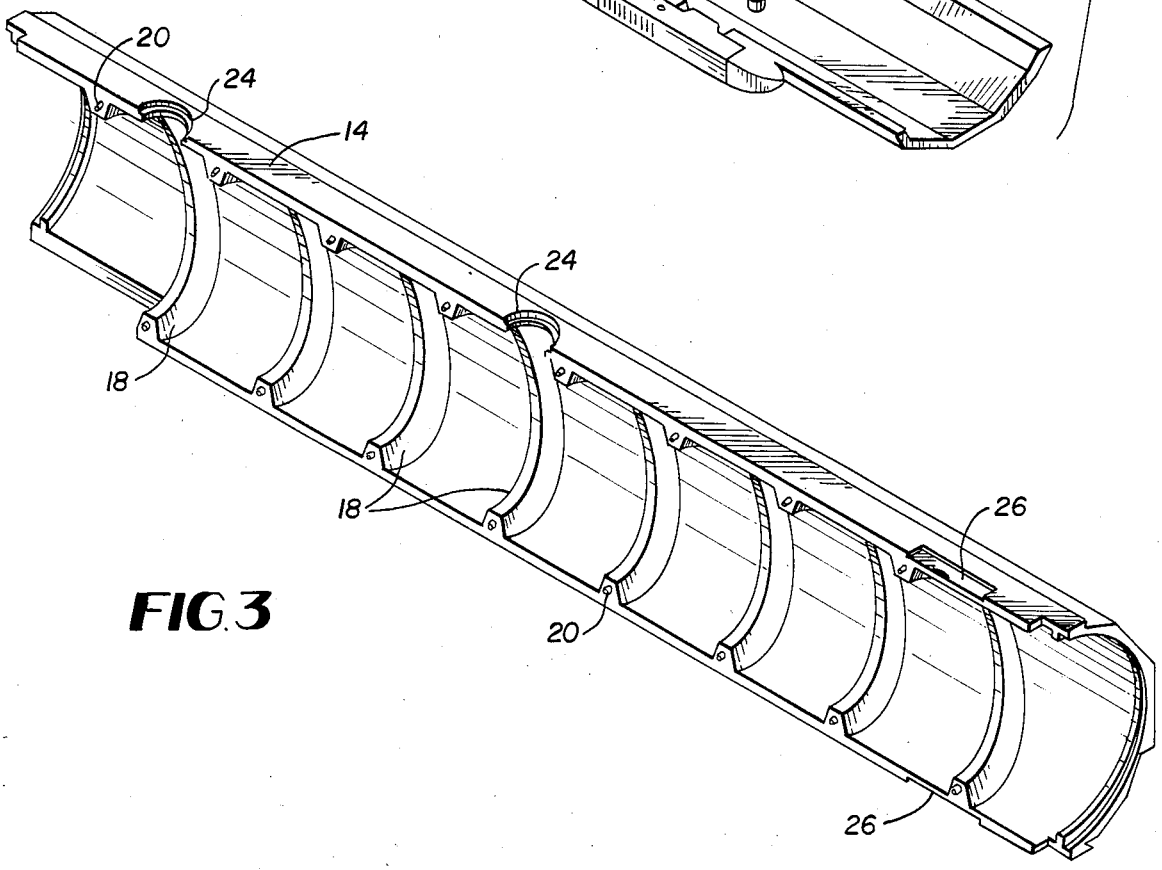
FIG. 3 is a view similar to FIG. 2 but showing only one half of the housing of the magazine according to the present invention.

FIG. 3 shows the right clam shell half 14, the symmetrical left clam shell half 16 being shown in FIGS. 4 and 5.

It is of course to be understood and is clear from the drawings that the two halves 14 and 16 are symmetrical with each other around an axial plane, and cooperate to form a continuous ammunition magazine housing, this being illustrated in FIG. 4.

Each clam shell half 14 and 16 includes a plurality of half screw threads 18 formed on the inside surface thereof. As is clear from FIG. 4, the screw thread halves 18 on both clam shell halves 14 and 16 fit together in such a way as to form one continuous screw thread as is required by the magazine and as is disclosed and discussed in detail in our prior co-pending application.

At the end of each screw thread half 18 is provided either a pin 20 or a mating opening 22. The pins and openings 20 and 22 are tapered as is shown in FIG. 4 to aid in location and to provide a tight fit between the halves 14 and 16. Further, the magazine is of substantially elongated configuration, in the particular embodiment shown in FIG. 3, eight turns are provided, and thus there are sixteen pairs of mating pins holes of 20 and 22. This substantial number of pairs of pins and openings provides a great deal of dimensional integrity and a tight secure fit between the two halves 14 and 16.

Each clam shell half 14 and 16 is provided with a pair of half window openings 24, and with a half securing slot 26. When the parts fit together, a full window opening as shown in FIG. 5 is provided and a full slot to receive the securing fingers of the clips as shown in FIG. 2 is provided between the halves 24 and 26, respectively.

As shown in the drawing, all of the pins 20 are on the right half 14, and thus, of course, all of the mating openings 22 will be provided on the left half 16. This arrangement could be modified in whatever way might be advantageous in any other environment, as is clear to those skilled in the art.

The remaining features of each clam shell half 14 and 16 as shown in the drawings pertain to the manner of operation of the magazine in cooperation with the gun G, and thus those features need not be described in any further detail herein. Again, reference may be had to our prior co-pending application for more details in this area.

FIG. 5 shows the halves 14 and 16 fitted together to create a complete opening made of the window half openings 24, and further shows the window 28 positioned therein and secured in place by the elongated securing clip 30. The window itself may be simply molded from any suitable clear plastic, and it is provided with a protective circular ridge 32 at its upper end. This ridge is of slightly larger diameter than the diameter 34 of the viewing opening in the clip 30, and thus the ridge 32 protects the lens or window 28 against scratching and the like as it might otherwise suffer in sliding the clip on and off the magazine absent the ridge 32. A mating shoulder arrangement 36 between the window and the halves 14 and 16 is provided to securely hold the window in place in cooperation with the clip 30.

While this disclosure shows two clips 30, it may be possible, in an appropriate application, to use only one clip 30, as, for example, by providing hinge means made of interfitting fingers on the side opposite the one clip 30.

As shown in FIGS. 2, 4, 5 and 6, the clam shell halves 14 and 16 are formed with securing means in the form of upstanding dove-tails 38 at their upper and lower edges closely adjacent the line of meeting between the halves. The elongated clips 30 are provided with edges which are turned downwardly and inwardly to grasp the dove-tails. Thus, the clips 30 are mounted and removed from the clam shell halves axially along the length of the magazine 10. This is the reason for the protective ridge 32 on the window, i.e., to protect the center viewing surface from scratching by the metal clips.

It should be noted that the two clips 30 may be identical. Securing means are provided top and bottom, but windows are provided only at the top. Thus, the two viewing windows 34 in the clip will be non-functional in the bottom position, but this has no effect on use of the invention magazine. The advantages which flow from providing two identical clips far out weighs the provision of non-functional openings at the bottom surface of the magazine. More importantly, the bottom surface is not seen at all when the magazine is mounted on a gun.

Figure 6:
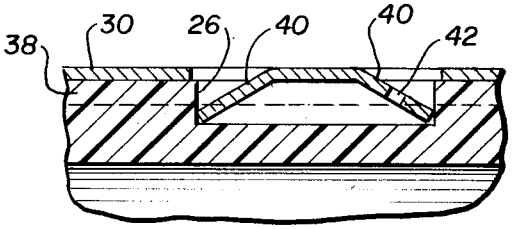
FIGS. 4, 5 and 6 are cross-sectional views taken on cutting lines 4—4, 5—5 and 6—6 of FIG. 2 respectively.

Means are provided to removably recure the clips 30 onto the halves 14 and 16, and to permit ready disassembly of the clips from the magazine. To this end, as shown in FIGS. 2 and 6, the rear end of the clips 30 are provided with a pair of punched out locking fingers 40 which depend downwardly out of the plane of the top surface of the clip and into the openings formed, top and bottom, by the mating securing slot halves 26. A small opening 42 is provided in the rear finger 40 to unlock the magazine.

In use, after assembly of the internal working parts of the magazine not forming a part of this invention, the invention housing providing all of the necessary support and location surfaces for these working parts, the clam shell halves are fitted together over the windows 28 and with the operative parts in position, and then the two clips 30 are merely slid over the dove-tails 38 until the fingers 40 "find" the openings formed by the slots 26, and spring down to their natural bent position inside the slots. That is the complete assembly procedure.

For disassembly, an implement such as a paper clip, a pen, pencil, or the like, is inserted into the opening 42 in the rear finger 50, the clip 30 is manipulated so that this rear finger 40 can be raised up out of the mating slots 26, and then the clip 30 can be slid off rearwardly, to the right in FIG. 2, from the magazine halves. After both clips are so removed, the halves 14 and 16 will readily come apart using no tools and only finger pressure and access can be had to the magazine's internal parts for repair, cleaning or whatever purpose.

This simplicity of assembly and disassembly provides enormous advantages as to economics, ease of manufacture, and permitting repair of other work on the invention magazine in the field. That is, if an internal part of the magazine should break or fail or jam, a knowledgeable user could repair the magazine himself, in the field.

While the invention has been described in some detail above, it is to be understood that this detailed description is by way of example only, and the protection granted is to be limited only within the spirit of the invention and the scope of the following claims.

We claim:

1. An axially elongated hollow housing for use in a separate and interchangeable ammunition magazine, said housing comprising a pair of housing halves symmetrical about a plane containing the axis of elongation of said housing, each of said housing halves including a plurality of segments of axially inwardly extending screw threads formed on the inside surface thereof, means to releasably join said housing halves together, said means to join comprising mating pins and openings formed at the ends of said screw thread segments, said screw thread segments being so positioned on their respective housing halves that said segments form a continuous screw thread when said housing halves are assembled together to form said housing, said screw thread segments defining a pitch and a radial height of said continuous screw thread, and said pitch and said radial height being related to the length and the diameter, respectively, of the particular size of the rounds of ammunition to be stored in said magazine so as to permit said rounds to feed in a helical path through said magazine.

2. The combination of claim 1, said mating pins and openings being of tapered configuration to aid in accurately locating said segments with respect to each other to form said continuous screw thread in the assembled housing.

3. The combination of claim 1, said releasable joining means comprising securing means formed on said housing halves in spaced relation to said axial plane, and said releasable joining means also comprising clip means to hold said housing halves in the assembled together condition of said housing.

4. The combination of claim 3, said clip means comprising at least one elongated clip formed of metal, said securing means comprising dove-tail means extending over substantially the entire length of said housing, and said at least one clip comprising a pair of elongated ledges that fit around said dove-tail means, whereby said clip may be slid on and off of said dove-tail means to assemble or disassemble said housing.

5. The combination of claim 4, said clip means and said securing means comprising two sets of said clips and dove-tail means arranged opposite each other at the intersections of said axial plane and said housing.

6. The combination of claim 4, said metal clip being formed with at least one integral locking finger extending axially inwardly, and said housing being formed with securing slot means cooperable with said locking finger to hold said clip locked onto said housing.

7. The combination of claim 6, and said locking finger being formed with a hole cooperable with a common implement to permit said locking finger to be released from said securing slot means to permit disassembly of said housing.

8. The combination of claim 4, and window means to permit viewing of the contents of said housing, and said housing being formed with openings which hold said window means therein in the assembled together condition of said housing.

9. The combination of claim 8, said window means comprising a window member formed of transparent plastic material, means to position said window means at the juncture between said housing halves, and said window member being formed with an upstanding ridge cooperable with said clip to protect the viewing surface of said window member from damage by said clip during assembly of said housing.

10. The combination of claim 8, said housing serving as an ammunition magazine, said window means comprising a pair of window members, means to position said window members on said magazine housing at the juncture between said housing halves so that a user can see into said magazine through said window means to determine when about half the ammunition in said magazine has been expended and when only a few rounds remain in said magazine.

11. The combination of claim 1, and window means to permit viewing of the contents of said housing, and means to mount said window means on said housing at at least two different locations thereon, whereby the presence or absence of the contents of said housing at said two different locations can be determined.

12. The combination of claim 1, the threads of said segments of screw threads having a truncated conical cross-sectional shape with the sides thereof slanted radially inwardly of the axis of said housing.

13. The combination of claim 1, both of said housing halves being formed entirely of molded plastic material.

14. An axially elongated hollow housing for use in a separate and interchangeable ammunition magazine, said housing comprising a pair of housing halves symmetrical about a plane containing the axis of elongation of said housing, each of said housing halves including a plurality of segments of axially inwardly extending screw threads formed on the inside of surface thereof, said screw thread segments being so positioned on their respective housing halves that said segments form a continuous screw thread when said housing halves are assembled together to form said housing, the threads of said segments of screw threads having a truncated conical cross-sectional shape with the sides thereof slanted radially inwardly of the axis of said housing, said screw thread segments defining a pitch and a radial height of said continuous screw thread, and said pitch and said radial height being related to the length and the diameter, respectively, of the particular size of the rounds of ammunition to be stored in said magazine so as to permit said rounds to feed in a helical path through said magazine.

* * * * *